US009127447B2

(12) United States Patent
Beaudoin

(10) Patent No.: US 9,127,447 B2
(45) Date of Patent: Sep. 8, 2015

(54) FRAME FOR AN INLET OF A CATCH BASIN OR MANHOLE

(71) Applicant: CANADA PIPE COMPANY ULC, Hamilton (CA)

(72) Inventor: Pierre-Laurent Beaudoin, Lévis (CA)

(73) Assignee: Canada Pipe Company ULC, Hamilton, Ontario (CA)

( * ) Notice: Subject to any disclaimer, the term of this patent is extended or adjusted under 35 U.S.C. 154(b) by 0 days.

(21) Appl. No.: 14/162,430

(22) Filed: Jan. 23, 2014

(65) Prior Publication Data

US 2014/0227030 A1 Aug. 14, 2014

Related U.S. Application Data

(63) Continuation-in-part of application No. 14/109,382, filed on Dec. 17, 2013.

(60) Provisional application No. 61/756,189, filed on Jan. 24, 2013.

(51) Int. Cl.
*E01F 5/00* (2006.01)
*E03F 5/04* (2006.01)
(Continued)

(52) U.S. Cl.
CPC . *E03F 5/04* (2013.01); *E02D 29/14* (2013.01); *E02D 29/1454* (2013.01); *E03F 5/0401* (2013.01); *E03F 5/14* (2013.01); *E05C 3/12* (2013.01); *E03F 5/06* (2013.01)

(58) Field of Classification Search
CPC ..... E01F 5/04; E01F 3/12; E01F 5/0401; E01F 5/06; E01F 5/14; E02D 29/14; E02D 29/1454
USPC ..... 404/2, 4, 25, 26; 52/19, 20
See application file for complete search history.

(56) References Cited

U.S. PATENT DOCUMENTS 490,301 A 1/1893 Munson
838,601 A 12/1906 Willms
(Continued)

FOREIGN PATENT DOCUMENTS

CA 1186871 5/1985
CA 1189294 6/1985
(Continued)

OTHER PUBLICATIONS

Gully Grating, Kerb Gratings, Products and Services, indiamart.com, searched Oct. 7, 2014, http://www.indiamart.com/jpkmetallics/kerb-gratings.html#gully-grating.
(Continued)

*Primary Examiner* — Raymond W Addie
(74) *Attorney, Agent, or Firm* — Fasken Martineau DuMoulin

(57) ABSTRACT

A frame for a cover for one of a catch basin and a manhole having an inlet, the frame comprising: a frame skeleton having a hollow body having a first end and a second end, the second end being adapted to be inserted into the inlet of the catch basin or manhole, the frame skeleton having at least one flange extending laterally outwardly from the first end of the hollow body and a concrete sleeve disposed around the hollow body on an external surface thereof, the concrete sleeve being adapted to be disposed between the inlet of the one of the catch basin and manhole and the at least one flange, the concrete sleeve having a top surface abutting the under surface of the at least one flange, the under surface of at least one flange covering the top surface of the concrete sleeve.

12 Claims, 8 Drawing Sheets

(51) Int. Cl.

| | |
|---|---|
| ***E03F 5/14*** | (2006.01) |
| ***E05C 3/12*** | (2006.01) |
| ***E02D 29/14*** | (2006.01) |
| *E03F 5/06* | (2006.01) |

(56) References Cited

U.S. PATENT DOCUMENTS

| | | | | |
|---|---|---|---|---|
| 1,460,733 | A | | 7/1923 | Rigby |
| 1,491,314 | A | | 4/1924 | Rigby |
| 1,763,174 | A | | 6/1930 | Morris |
| 1,858,268 | A | | 5/1932 | Fleming |
| 2,701,027 | A | | 2/1955 | Scoville |
| 3,304,685 | A | | 2/1967 | Whetstone |
| 3,838,706 | A | | 10/1974 | Klenk et al. |
| D244,854 | S | | 6/1977 | Salamone |
| 4,126,404 | A | | 11/1978 | Ferns |
| 4,279,541 | A | | 7/1981 | Bruhn et al. |
| D267,268 | S | | 12/1982 | Johnson |
| D270,292 | S | | 8/1983 | Johnson |
| 4,422,994 | A | | 12/1983 | Ditcher |
| D280,126 | S | | 8/1985 | Provan et al. |
| 4,536,103 | A | | 8/1985 | Prescott |
| 4,565,347 | A | | 1/1986 | Ditcher |
| 4,591,290 | A | | 5/1986 | Prescott |
| 4,685,650 | A | | 8/1987 | Ditcher |
| 4,737,220 | A | * | 4/1988 | Ditcher et al. ..... 156/218 |
| 4,801,417 | A | | 1/1989 | Ditcher |
| 4,941,643 | A | | 7/1990 | Ditcher |
| 4,952,094 | A | | 8/1990 | Spiess et al. |
| 5,072,846 | A | | 12/1991 | Portwood |
| 5,095,667 | A | * | 3/1992 | Ryan et al. ..... 52/20 |
| D337,296 | S | | 7/1993 | Steinke et al. |
| 5,279,007 | A | | 1/1994 | Kolada |
| 5,299,884 | A | * | 4/1994 | Westhoff et al. ..... 404/25 |
| D352,573 | S | | 11/1994 | Sampson et al. |
| 5,386,669 | A | | 2/1995 | Almeida |
| D369,404 | S | | 4/1996 | Vestal |
| 5,634,739 | A | | 6/1997 | Armstrong |
| 5,849,181 | A | | 12/1998 | Monteith |
| 6,045,691 | A | | 4/2000 | McDermott |
| 6,068,765 | A | | 5/2000 | Monteith |
| 6,109,824 | A | | 8/2000 | Annès |
| 6,270,662 | B1 | | 8/2001 | Gibson et al. |
| 6,385,913 | B1 | | 5/2002 | Ahn |
| 6,537,446 | B1 | | 3/2003 | Sanguinetti |
| 6,869,525 | B1 | | 3/2005 | Happel |
| 6,986,226 | B2 | | 1/2006 | Banks |
| 7,040,838 | B2 | | 5/2006 | Allard et al. |
| D596,273 | S | | 7/2009 | Porter |
| D630,714 | S | | 1/2011 | Dukes |
| D658,440 | S | | 5/2012 | Funnell, II et al. |
| 8,182,171 | B2 | * | 5/2012 | Poulsen ..... 404/26 |
| 8,292,541 | B2 | | 10/2012 | Akkala |
| 8,591,729 | B2 | | 11/2013 | Alqanee |
| D699,820 | S | | 2/2014 | Beaudoin |
| D699,821 | S | | 2/2014 | Beaudoin |
| D722,366 | S | | 2/2015 | Beaudoin |
| D722,678 | S | | 2/2015 | Beaudoin |
| D725,238 | S | | 3/2015 | Beaudoin |
| 2002/0071722 | A1 | | 6/2002 | Allard |
| 2003/0046877 | A1 | | 3/2003 | Banks |
| 2004/0112811 | A1 | | 6/2004 | Lindemulder |
| 2006/0011527 | A1 | | 1/2006 | McDermott et al. |
| 2006/0230688 | A1 | | 10/2006 | Carr |
| 2008/0179229 | A1 | | 7/2008 | Dorsey |
| 2010/0124458 | A1 | | 5/2010 | Munro |
| 2013/0186811 | A1 | | 7/2013 | Kaiser |

FOREIGN PATENT DOCUMENTS

| | | | |
|---|---|---|---|
| CA | 1204317 | | 5/1986 |
| CA | 1208025 | | 7/1986 |
| CA | 1245832 | | 12/1988 |
| CA | 1320071 | | 7/1993 |
| CA | 2153008 | A1 | 1/1996 |
| CA | 2220243 | A1 | 9/1997 |
| CA | 2206338 | A1 | 11/1998 |
| DE | 1002249 | | 2/1957 |
| DE | 6906871 | | 6/1969 |
| DE | 1905728 | | 8/1970 |
| DE | 4437518 | A1 | 4/1996 |
| DE | 29707603 | | 8/1997 |
| EP | 0337110 | A1 | 10/1989 |
| EP | 0668409 | A1 | 8/1995 |
| EP | 0694654 | A1 | 1/1996 |
| EP | 0811732 | A1 | 12/1997 |
| EP | 1254991 | A2 | 11/2002 |
| FR | 2200415 | | 4/1974 |
| FR | 2384904 | | 10/1978 |
| FR | 2740789 | A1 | 5/1997 |
| FR | 2803859 | A1 | 7/2001 |
| FR | 2920163 | A1 | 2/2009 |
| GB | 2205601 | | 12/1988 |
| WO | 96/01929 | A1 | 1/1996 |
| WO | 97/26415 | A1 | 7/1997 |
| WO | 97/49872 | A1 | 12/1997 |
| WO | 01/83892 | A1 | 11/2001 |

OTHER PUBLICATIONS

Industries Fortier LTÉE, "Catch Basin", datasheet, 1 page, publicly available at least as of Dec. 17, 2012, Canada.

Groupe Lecuyer, "Catch basin for rectangular cast iron grate of 455mm × 915mm", datasheet, 1 page, available on the internet at http://www.lecuyerbeton.com/en/products/storm-and-sanitary-products/catch-basins-and-manholes-catch-basins/regards-puisards at least as of Jan. 9, 2009, Canada.

Béton Provincial, "Reinforced concrete catch basins", datasheet, 1 page, available on the internet at http://www.betonprovincial.com/public/files/pdf/en/manuel-techniques/Reinforced-Concrete-Catch-Basins.pdf at least as of Apr. 7, 2009, Canada.

* cited by examiner

FRAME FOR AN INLET OF A CATCH BASIN OR MANHOLE

TECHNICAL FIELD

The invention relates to a frame for an inlet of a catch basin or a manhole.

BACKGROUND OF THE ART

During road construction, storm drains (also known as catch basins) and sewer inlets are disposed at various points along the road to evacuate excess water and/or debris that may accumulate. Such accumulation can occur for example during rainfall.

The storm drains (or catch basins) are connected to a system which is a network of pipes, pumps, and force mains for the collection of wastewater, or sewage, from the community. Typically, storm drains use a separate and distinct network from sanitary sewer systems for human waste. Sometimes a combined system provides only one network for all types of sewage and excess water or debris.

In order to evacuate the excess water and debris toward the system, the storm drain includes an inlet disposed on the road surface. Two main types of inlets exist: the side inlet and the grated inlet. The typically ends in an outlet for the water which is a single large exit at the point of discharge. The separation of storm sewers from sanitary sewers helps to prevent sewage treatment plants becoming overwhelmed by infiltration/inflow during a rainstorm, which can result in untreated sewage being discharged into the environment.

The grated inlets prevent pedestrians, vehicles and large objects from falling into the storm drain. The design of the grate bars facilitates a flow of water towards the inside of the drain. Storm drains provided in streets and parking areas must be strong enough to support the weight of the vehicles. Some of the heavier sediment and small objects or debris may enter the grated inlet and settle in the catchbasin below the inlet. A frame is provided for the catchbasin or catch pit and the grate covers the open top of the frame of the catchbasin. The frame supports the grate/cover.

It is common to have the frames disposed floatingly on the catch basin/manhole inlets. In a floating arrangement, the concrete constituting the road is poured around the sides of the frame and provides the connection between the road and the frame. No additional connection is used to secure the frame to the road. As such, movements between the road and the frame, which could happen during frosting and defrosting periods, is absorbed by the relative flexibility of the connection between them. To install the frame while pouring the concrete to make the road, the frame is first inserted in a guiding holder. The guiding holder is fixedly connected to the catch basin inlet. Wood shims are used to position the frame in place into the guiding holder. An inconvenience with that method is that the wooden shims may displace during the concrete pouring operation, which in turn can induce imprecise alignment between the frame and the catch basin. Over time, water infiltration can occur and premature wear of the frame and its connection to the road can happen.

To reduce the imprecision of the wood shim technique, some have fixedly attached the frame into the concrete road. However, any further adjustment is prevented and replacement of portions of the road would be needed should the frame need to be changed.

SUMMARY

In accordance with one aspect, there is provided a frame for a cover for one of a catch basin and a manhole, the one of the catch basin and the manhole having an inlet, the frame comprising: a frame skeleton having a hollow body, the hollow body having a first end and a second end, the second end of the hollow body being adapted to be inserted into the inlet of the one of the catch basin and the manhole, the frame skeleton having at least one flange extending laterally outwardly from the first end of the hollow body, a surface of the at least one flange facing the second end being an under surface of the at least one flange; and a concrete sleeve disposed around the hollow body on an external surface thereof, the concrete sleeve being adapted to be disposed between the inlet of the one of the catch basin and manhole and the at least one flange, the concrete sleeve having a top surface abutting the under surface of the at least one flange, the under surface of at least one flange covering the top surface of the concrete sleeve.

In one embodiment, the hollow body has an asymmetrical cross-section.

In one embodiment, the hollow body has a truncated circular cross-section.

In one embodiment, the frame skeleton further includes at least one outwardly extending anchor point disposed on the external surface of the hollow body, the outwardly extending anchor point being adapted to connect with the concrete sleeve.

In one embodiment, the frame skeleton further includes at least one aperture provided on an extension of the hollow body, the aperture being adapted to connect with the concrete sleeve using attachment means.

In one embodiment, the external surface of the hollow body is tapered outwardly from the second end to the first end of the hollow body.

In one embodiment, the hollow body has an inside surface, and the inside surface is vertically straight.

In one embodiment, the at least one flange includes at least one groove.

In one embodiment, an outer perimeter of the at least one flange has a same shape of an inner perimeter of the at least one flange.

In one embodiment, the at least one flange has at least one section with a width narrower than a main width of the at least one flange.

In one embodiment, the frame skeleton includes a plurality of U-shaped anchor points disposed on an inside surface of the hollow body.

In one embodiment, the hollow body has an inside surface, and the inside surface includes a recess at the first end of the hollow body for receiving the cover, the cover being one of a grate and a closed cover.

In accordance with another aspect, there is provided a method for making a frame for an inlet of one of a catch basin and a manhole, the method comprising: providing a frame skeleton, the frame skeleton having a hollow body, the hollow body having a first end and a second end, the second end of the hollow body being adapted to be inserted into the inlet of the one of the catch basin and the manhole, the frame skeleton having at least one flange extending laterally outwardly from the first end of the hollow body, a surface of the at least one flange facing the second end being an under surface of the at least one flange; and assembling a concrete sleeve around the hollow body to form the frame before placing the frame into the inlet of the one of the catch basin and manhole, the concrete sleeve being adapted to be disposed between the inlet of one of the catch basin and manhole and the at least one flange, the concrete sleeve having a top surface abutting the under surface of the at least one flange, the under surface of at least one flange covering the top surface of the concrete sleeve.

In one embodiment, assembling the concrete sleeve includes casting the concrete sleeve around the hollow body.

In one embodiment, the assembling the concrete sleeve includes attaching the concrete sleeve to the hollow body using attachment means and openings on the hollow body.

In one embodiment, the method further comprises casting the frame skeleton before providing the frame skeleton.

In accordance with another broad aspect, there is provided a frame for one of a catch basin and a manhole is provided. The one of the catch basin and the manhole has an inlet. The frame comprises a frame skeleton having a hollow body. The hollow body has a first end and a second end. The second end of the hollow body is adapted to be inserted into the inlet of the one of the catch basin and the manhole. The frame skeleton has at least one flange extending laterally outwardly from the first end of the hollow body. A surface of the at least one flange facing the second end is an under surface of the at least one flange. A concrete sleeve is disposed around the hollow body on an external surface thereof. The concrete sleeve is adapted to be disposed vertically between the inlet of the one of the catch basin and manhole and the at least one flange. The concrete sleeve has a top surface abutting the under surface of the at least one flange. The under surface of at least one flange covers totally the top surface of the concrete sleeve.

In one embodiment, the frame skeleton further includes a plurality of outwardly extending anchor points disposed on the external surface of the hollow body. The plurality of outwardly extending anchor points connect with the concrete sleeve.

In one embodiment, the external surface of the hollow body is tapered outwardly from the second end to the first end of the hollow body.

In one embodiment, the hollow body has an inside surface. The inside surface is substantially vertically straight.

In one embodiment, the at least one flange includes at least one groove.

In one embodiment, an outer perimeter of the at least one flange has a same shape of an inner perimeter of the at least one flange.

In one embodiment, the frame skeleton includes a plurality of U-shaped anchor points disposed on an inside surface of the hollow body.

In one embodiment, the hollow body has an inside surface, and the inside surface includes a recess at the first end of the hollow body.

In accordance with still another broad aspect, there is provided a method for making a frame for an inlet of one of a catch basin and a manhole is also provided. The method comprises providing a frame skeleton. The frame skeleton has a hollow body. The hollow body has a first end and a second end. The second end of the hollow body is adapted to be inserted into the inlet of the one of the catch basin and the manhole. The frame skeleton has at least one flange extending laterally outwardly from the first end of the hollow body. A surface of the at least one flange faces the second end being an under surface of the at least one flange. The method comprises casting a concrete sleeve around the hollow body to form the frame before placing the frame into the inlet of the one of the catch basin and manhole. The concrete sleeve is adapted to be disposed vertically between the inlet of one of the catch basin and manhole and the at least one flange. The concrete sleeve has a top surface abutting the under surface of the at least one flange. The under surface of at least one flange covers totally the top surface of the concrete sleeve.

In one embodiment, the method of comprises casting the frame skeleton before providing the frame skeleton.

Embodiments of the present can have at least one of the above-mentioned aspects, but do not necessarily have all of them.

Additional and/or alternative features, aspects, and advantages of embodiments of the present will become apparent from the following description, the accompanying drawings, and the appended claims.

BRIEF DESCRIPTION OF THE DRAWINGS

Having thus generally described the nature of the invention, reference will now be made to the accompanying drawings, showing by way of illustration embodiments, aspects and features thereof and in which.

It will be noted that throughout the appended drawings, like features are identified by like reference numerals.

DETAILED DESCRIPTION

Figure 1:
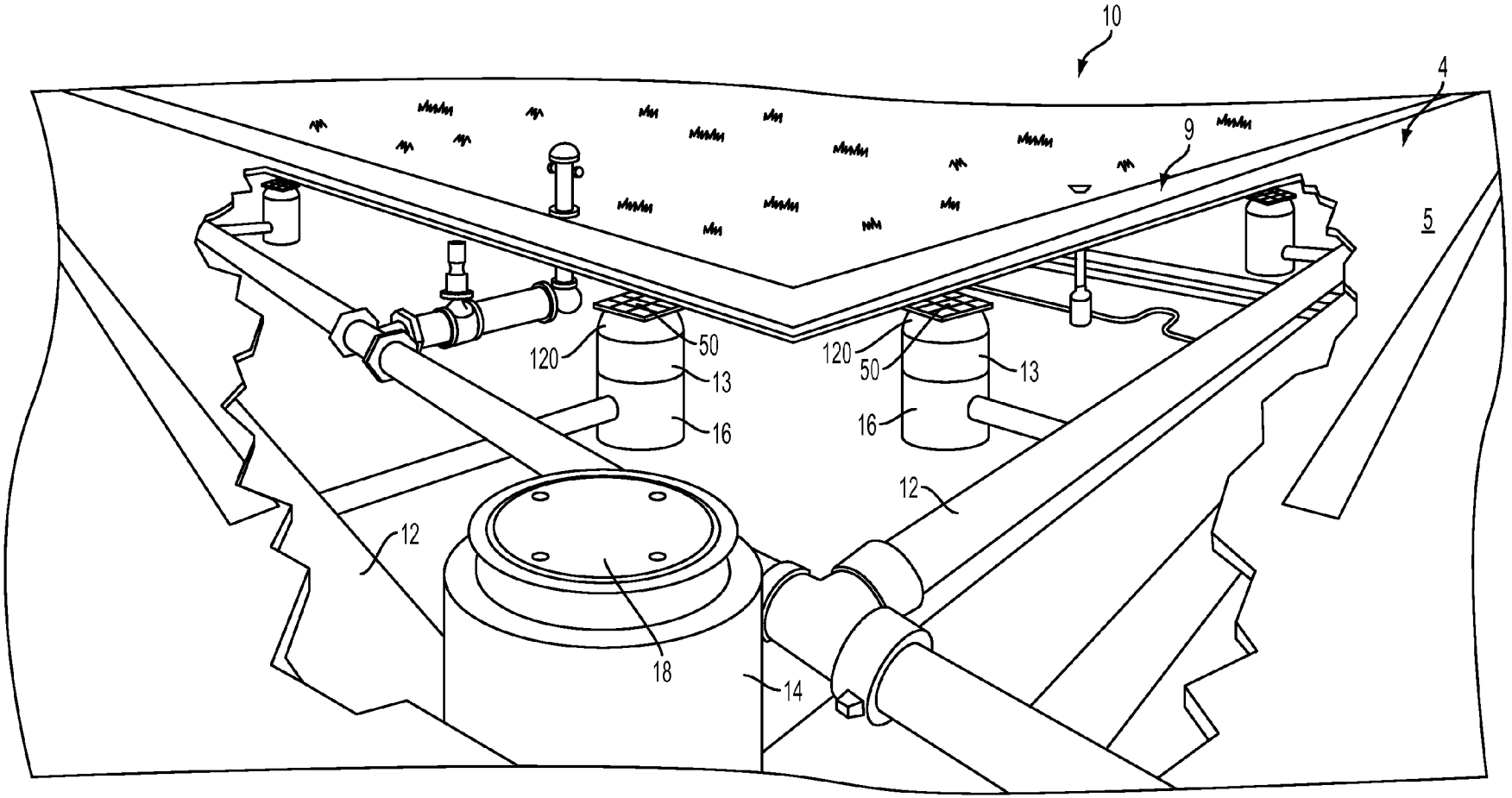
FIG. 1 is an illustration of a road partially cut out to reveal a system including a plurality of catch basins, drains and manholes.

Referring to FIG. 1, a sewerage system 10 includes a plurality of interconnected pipes or conduits 12, disposed underground below a concrete or paved road 4. A plurality of manholes 14 and catch basins 16 connect the sewerage system 10 to an upper surface 5 of the road 4. As illustrated in FIG. 1, the catch basins 16 are located on lateral sides of the road 4 near sidewalks or curbs 9, while the plurality of manholes 14 are found toward a middle of the road 4. The manholes 14 have closed covers 18 which do not allow the passage of debris, while the catch basins 16 have open grated covers 50 which allow passage of excess water and small debris. A frame 100 (described in detail below) connects the grate 50 to its associated catch basin 16. While the below description refers to the frame 100 disposed onto the catch basin 16 having the grate 50, it is contemplated that the frame 100 could be disposed onto a manhole 14 having a cover 18. It is contemplated that one, some or all of the plurality of manholes 14 could be provided with grated covers 50 instead of closed covers 18. The frame 100 will be described in detail below.

Figure 2:
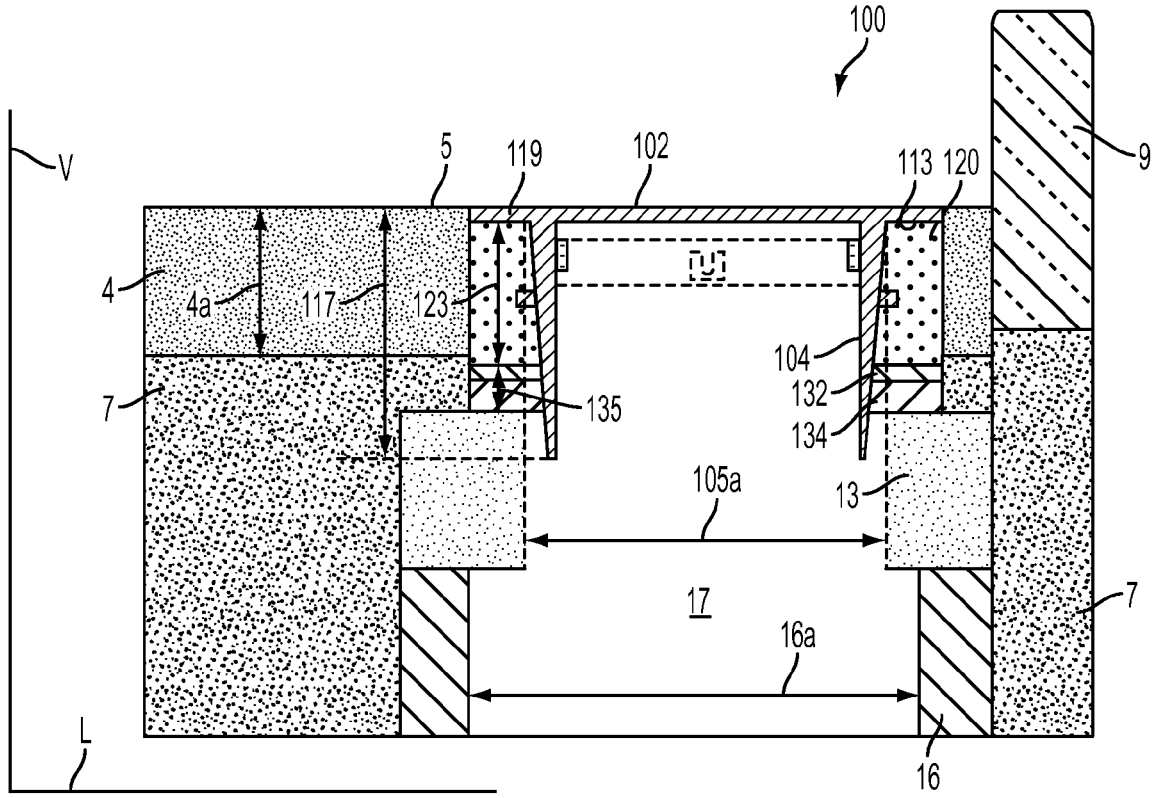
FIG. 2 is a cross-sectional view of one of the catch basins of FIG. 1 revealing a frame disposed thereon.
Figure 3:
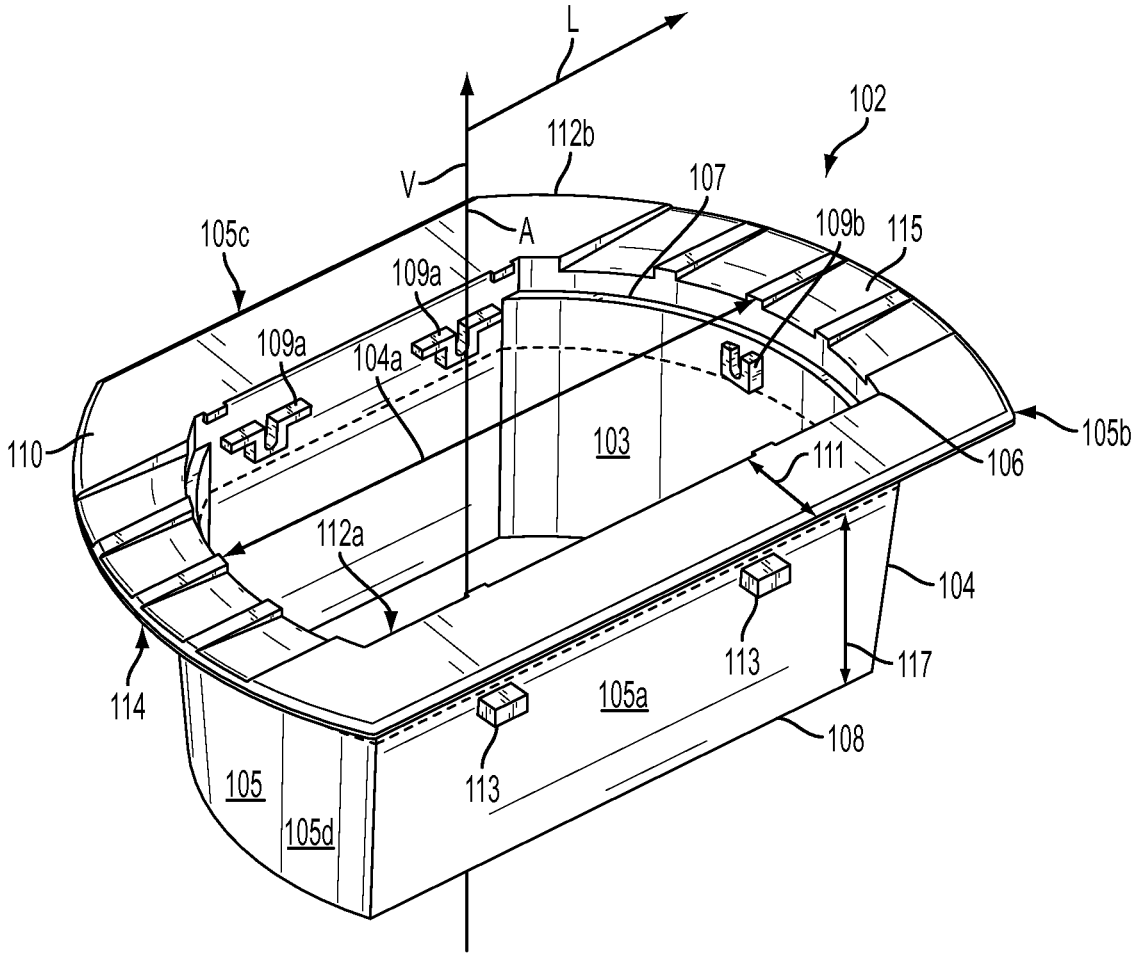
FIG. 3 is a perspective view of a frame skeleton of the frame of FIG. 2.

Referring to FIGS. 2 and 3, an assembly of the catch basin 16 with the frame 100 into the road 4 will be described. The description will refer to the following orientations: vertical will be along a vertical direction V, and horizontal/lateral will be along a lateral direction L defined with respect to a center axis A of the frame 100. Should the frame 100 be symmetrical around the center axis A, the lateral direction L would be radial direction.

The catch basin 16 has an inlet 17 proximal to the road 4. The inlet 17 is surrounded by a concrete head 13. The concrete head 13 allows to reduce a width 16*a* of the inlet 17 of the catch basin 16 to a width 105*a* which corresponds to a largest width of an outside surface 105 of a hollow body 104 of the frame 100. The hollow body 104 will be described below. It is contemplated that the concrete head 13 could be omitted, should the width 16*a* of the catch basin 16 generally match the width 105*a* of the hollow body 104 of the frame 100. The frame 100 is disposed on top of the concrete head 13 and extends partially thereinto. It is contemplated that the frame 100 could extend partially into the inlet 17 of the catch basin 16. The top surface of the frame 100 ends flush with the upper surface 5 of the road 4. A method of assembling the frame 100 to the catch basin 16 and the road 4 will be described below.

It is contemplated that the inlet 17 or the concrete head 13 may be offset with respect to the center of the catch basin or manhole to allow an installation of the frame 100 and grate/cover 50 closer to the curb. Additionally or alternatively, the frame 100 may be asymmetrical or excentric to provide the grate/cover 50 closer to the curb.

Shims 132, 134 allow adjustment of a distance between the frame 100, the concrete head 13, and the road 4. The shims 132, 134 are made of cast iron. It is contemplated that the shims 132, 134 could be made of ductile iron, or steel, or hard rubber, or a polymer, or any suitable material that would resist to wear. A shape of an inside surface of the shims 132, 134 corresponds to a shape of a cross-section of the outside surface 105 of the hollow body 104 of the frame 100.

Gravel 7 is disposed around the catch basin 16 and the concrete head 13. The road 4 is disposed vertically above the gravel 7 and surrounds a top portion of the frame 100. The frame 100 is shown in the Figures as being vertically disposed on top of the catch basin inlet 17, but it is contemplated that the frame 100 could be at an angle with the top of the catch basin inlet 17. For example, if the road 4 is at an angle with the top of the catch basin inlet 17, the frame 100 would be disposed at an angle with the catch basin inlet 17. In one embodiment, the shims 132, 134 are sized and shaped to allow the frame 100 to be disposed at such an angle.

Figure 4:
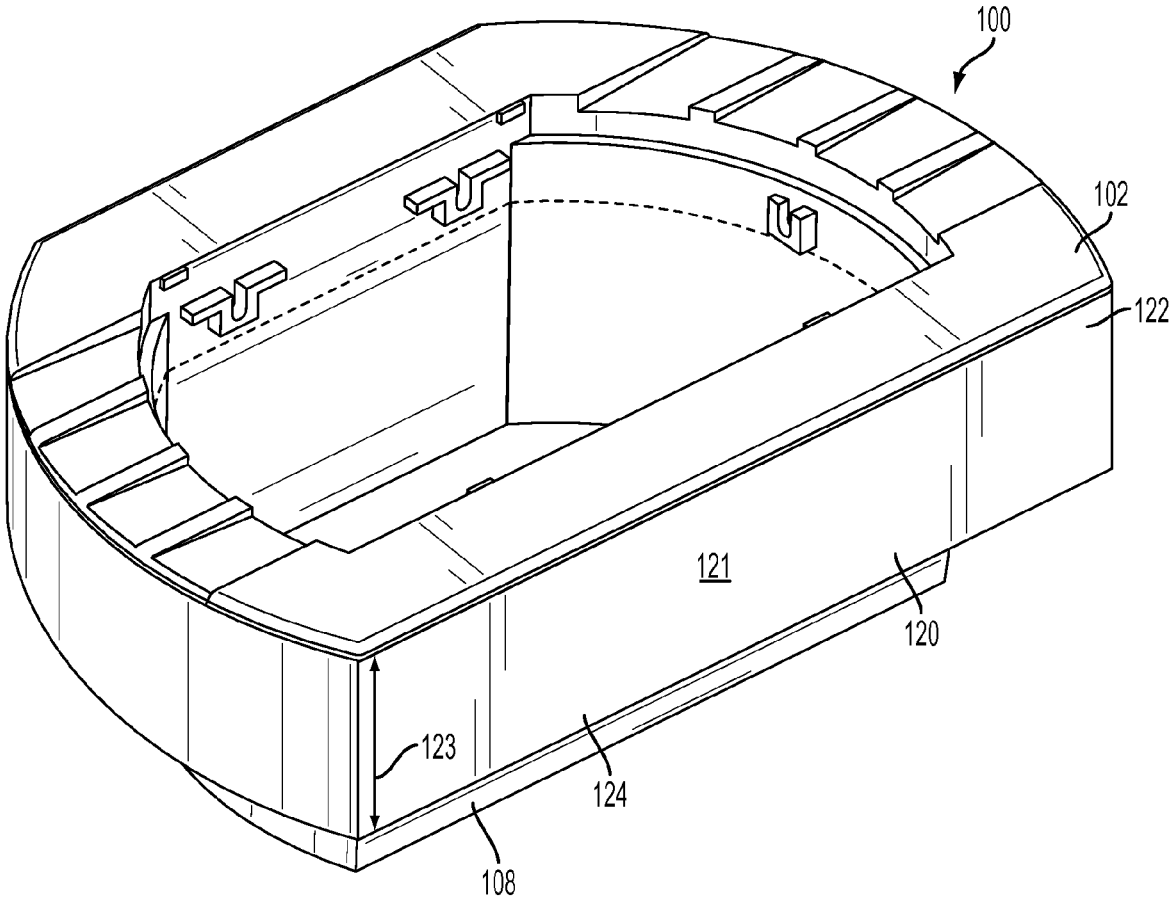
FIG. 4 is a perspective view of the frame skeleton of FIG. 3 with a concrete sleeve thereby forming the frame of FIG. 2.

Turning to FIGS. 3 and 4, the frame 100 will now be described. The frame 100 includes a frame skeleton 102 and a concrete sleeve 120.

The frame skeleton 102 is made of ductile iron. It is contemplated that the frame skeleton 102 could be made of cast iron, or a polymer, or hard rubber, or any material that would be suited for use as a frame skeleton (for example, at least low deformation property and resistant to wear and weather). The frame skeleton 102 includes the hollow body 104, which has a first end 106 and a second end 108. The first and second ends 106, 108 are open. When in place, the first end 106 is disposed proximal to the upper surface 5 of the road 4 and the second end 108 is disposed distal to the upper surface 5 of the road 4. As such, the first end 106 indicates globally a top of the frame 100.

The hollow body 104 has an asymmetrical or excentric cross-section. More particularly, it has an asymmetrical truncated circular cross-section. The hollow body 104 includes first and second straight sides 105*a,c* and first and second curved sides 105*b,d*. The first curved side 105*b* adjoins the first straight side 105*a*. The second straight side 105*c* adjoins the first curved side 105*b* and is shorter than the first straight side 105*a*. The second curved side 105*d* adjoins the second straight side 105*c* and the first straight side 105*a*. The first and second curved sides 105*b,d* are each disposed between the first and second straight sides 105*a,c* and at opposite ends thereof. It is contemplated, however, that the hollow body 104 could have a cross-section other than the ones shown in the Figures. For example, the hollow body 104 could have a circular cross-section or a rectangular cross-section or any other shape desired.

An inside surface 103 of the hollow body 104 is generally vertically straight. The inside surface 103 has a small angle with respect to the vertical V to allow its removal from a mold during its making), but it is contemplated that the inside surface 103 of the hollow body 104 could be more slanted than shown in the Figures or have a variety of highs and dips. As best seen in FIG. 2, an outside surface 105 of the hollow body 104 is tapered slightly outwardly from the second end 108 to the first end 106. It is contemplated that the outside surface 105 could be straight or have a taper angle higher or lower than shown in the Figures. It is also contemplated that the outside surface 105 could have a variety of highs and dips.

The inside surface 103 includes a recess 107 near the first end 106. The recess 107 allows the grate 50 to be disposed thereon. The inside surface 103 also features a plurality of U-shaped anchor points 109*a*, 109*b*. The U-shaped anchor points 109*a*, 109*b* receive rods (not shown) which are used as retainers should the grate 50 or a large object fall into the catch basin 16. It is contemplated that the U-shaped anchor points 109*a*, 109*b* could have a shape different from the ones shown in the Figures and could be placed at locations on the inside surface 103 other than shown in the Figures, as long as they allow to catch at least partially the grate 50 or a large object that would fall into the catch basin 16. It is contemplated the U-shaped anchor points 109*a*, 109*b* could be omitted if the application does not require use of the rods or if the rods are attached to the frame using other means.

The outside surface 105 includes two pairs of anchor points 113 on the first and second straight sides 105*a,c*. The anchor points 113 facilitate connection with a concrete sleeve 120. The concrete sleeve 120 and a method of assembling the concrete sleeve to the frame skeleton 102 will be described below. The anchor points 113 further restrict movement between the concrete sleeve 120 and the frame skeleton 102 should the concrete sleeve 120 at least partially move with respect to the frame skeleton 102.

Figure 7:
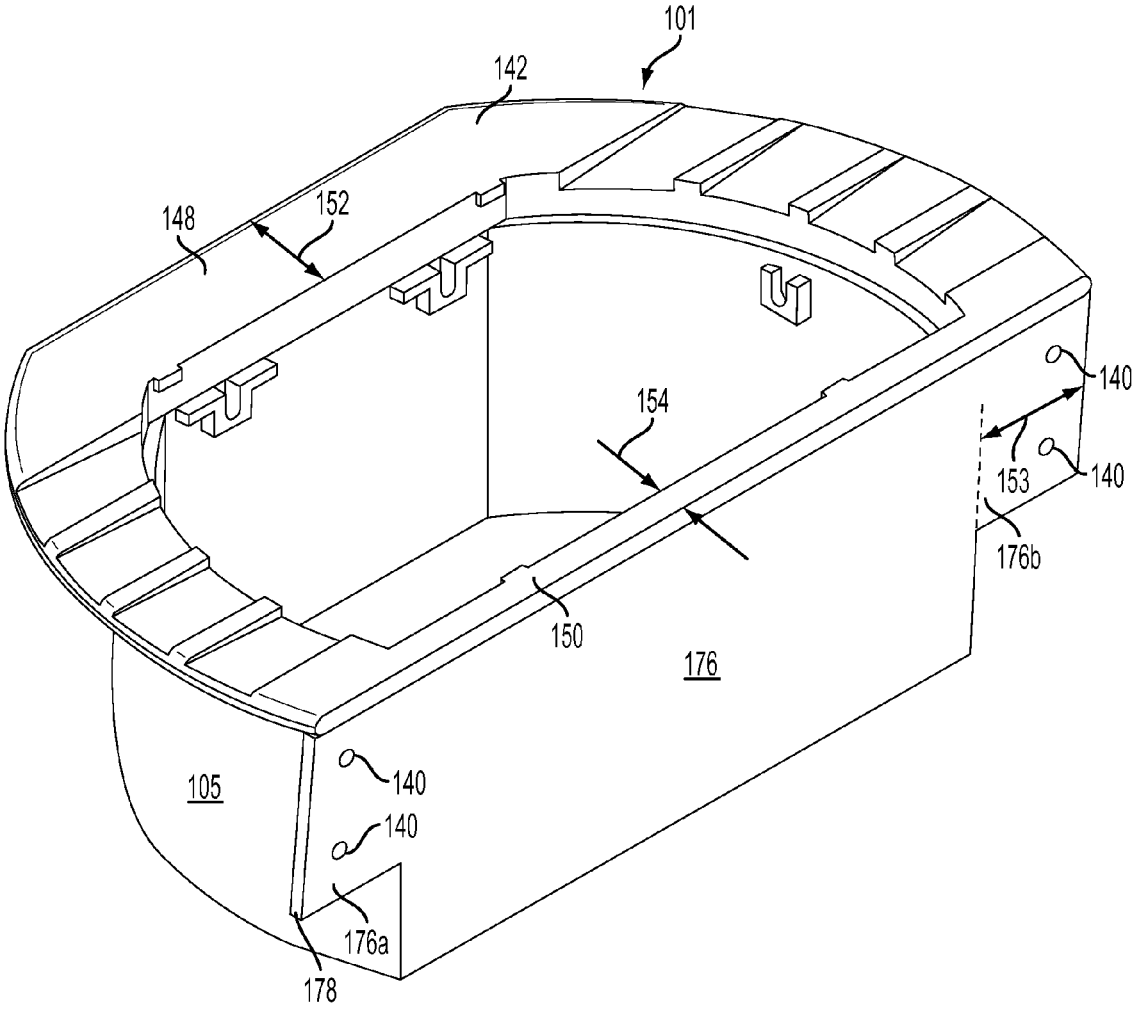
FIG. 7 is a perspective view of an alternative frame skeleton with extensions and openings.

FIG. 7 shows an alternative embodiment in which anchor points 113 are omitted. Wall 176 has extensions 176*a* and 176*b* extending from wall 176. Width 153 of extensions 176*a*, 176*b* ensures that the extensions are covered by flange 148 while extending beyond the surface 105 of the hollow body of the frame skeleton 142. Openings 140 provided on extensions 176*a* and 176*b* are used to assemble the alternative frame skeleton 142 to the concrete sleeve 144 with a shape adapted to receive the alternative frame skeleton 142.

Referring back to FIGS. 3 and 4, the first end 106 of the hollow body 104 includes a laterally extending flange 110 with four sides. The laterally extending flange 110 extends around the first end 106 (inner perimeter 112*a* of the laterally extending flange 110). It is contemplated that the hollow body 104 could have more than one laterally extending flange. It is also contemplated that the hollow body 104 could have a laterally extending flange extending only around a portion of the first end 106. It is also contemplated that flange 110 could extend only on some sides of the first end of the hollow body 104.

The laterally extending flange 110 has an outer perimeter 112*b* whose shape is shown as matching a shape of the cross-section of the inside surface 103 of the hollow body 104 and a shape of the inner perimeter 112*a*. It is contemplated however that the shape of the outer perimeter 112*b* could differ from the inside perimeter 112*a*. For example, the inner perimeter 112*a* could be circular and the outer perimeter 112*b* could be square. The lateral extending flange 110 has a width 111. Although in the laterally extending flange 110 described herein has the width 111 generally constant throughout, it is contemplated that the laterally extending flange 110 could have a different width throughout. For example, a width of the laterally extending flange 110 on the first and second straight sides 105*a,c* could be longer than a width on the first and second curved sides 105*b,d* of the hollow body 104.

As shown in FIG. 7, alternative frame skeleton 142 has an alternatively shaped flange 148. Flange 148 is three-sided since the flange section 150 does not extend radially outward from wall 176. Width 152 of the wider section of the flange 148 is greater than width 154 of flange section 150. In one embodiment, width 152 can correspond to the thickness of wall 176. This embodiment facilitates installation of the grate/cover closer to the curb, sidewalk or side of the road.

Referring back to FIG. 3, the laterally extending flange 110 includes a plurality of discharge grooves 115. The discharge grooves 115 are slightly slanted with respect to the horizontal toward the inside 103 of the hollow body 104 so as to facilitate water to flow from the road 4 toward the inlet 17 of the catch basin 16. It is contemplated that the discharge grooves 115 could be different from shown in the Figures. For example, the laterally extending flange 110 could have only one discharge groove. In another example, the discharge groove is larger than the ones shown in the Figures. It is also contemplated that the lateral extending flange 110 could not have any discharge groove.

Turning now to FIG. 4, a portion of the outside surface 105 is covered by a concrete sleeve 120. The concrete sleeve 120 has a first end 122 located at the first end 106 of the hollow body 104. A top surface 119 of the concrete sleeve 120 abuts an under surface 114 of the laterally extending flange 110. The under surface 114 covers totally the top surface 119 of the concrete sleeve. As a consequence, when in place on the catch basin 16, the concrete sleeve 120 is covered by the flange 110, which reduces water infiltration which in turn reduces wear of the frame 100. Although the concrete sleeve 120 is shown herein to be vertically aligned with the width 111 of the laterally extending flange 110, it is contemplated that the concrete sleeve 120 could be shorter than the laterally extending flange 110. In other words, the laterally extending flange 110 could extend beyond the concrete sleeve 120 laterally.

A second end 124 of the concrete sleeve 120 is disposed at a distance from the second 108 of the hollow body 104. As such, a height 123 of the concrete sleeve 120 is shorter than the height 117 of the hollow body 104, and the concrete sleeve 120 is disposed around only a portion of the outside surface 105. The height 123 of the concrete sleeve 120 matches a height 4*a* of the concrete road 4 as shown in FIG. 2. Because the concrete sleeve 120 is shorter than the hollow body 104, the second end 108 of the hollow body 104 extends within the concrete head 13. As a consequence, should there be any lateral movement of the frame 100, it would be limited by an abutment of the second end 108 of the hollow body 104 onto the catch basin inlet 17. The second end 108 of the hollow body 104 extending within the catch basin inlet 17 also acts as a guide to facilitate positioning of the frame 100 during installation onto the catch basin 16. In the present embodiment, the concrete sleeve 120 does not extend laterally beyond the laterally extending flange 110, as best illustrated in FIG. 2.

Figure 6:
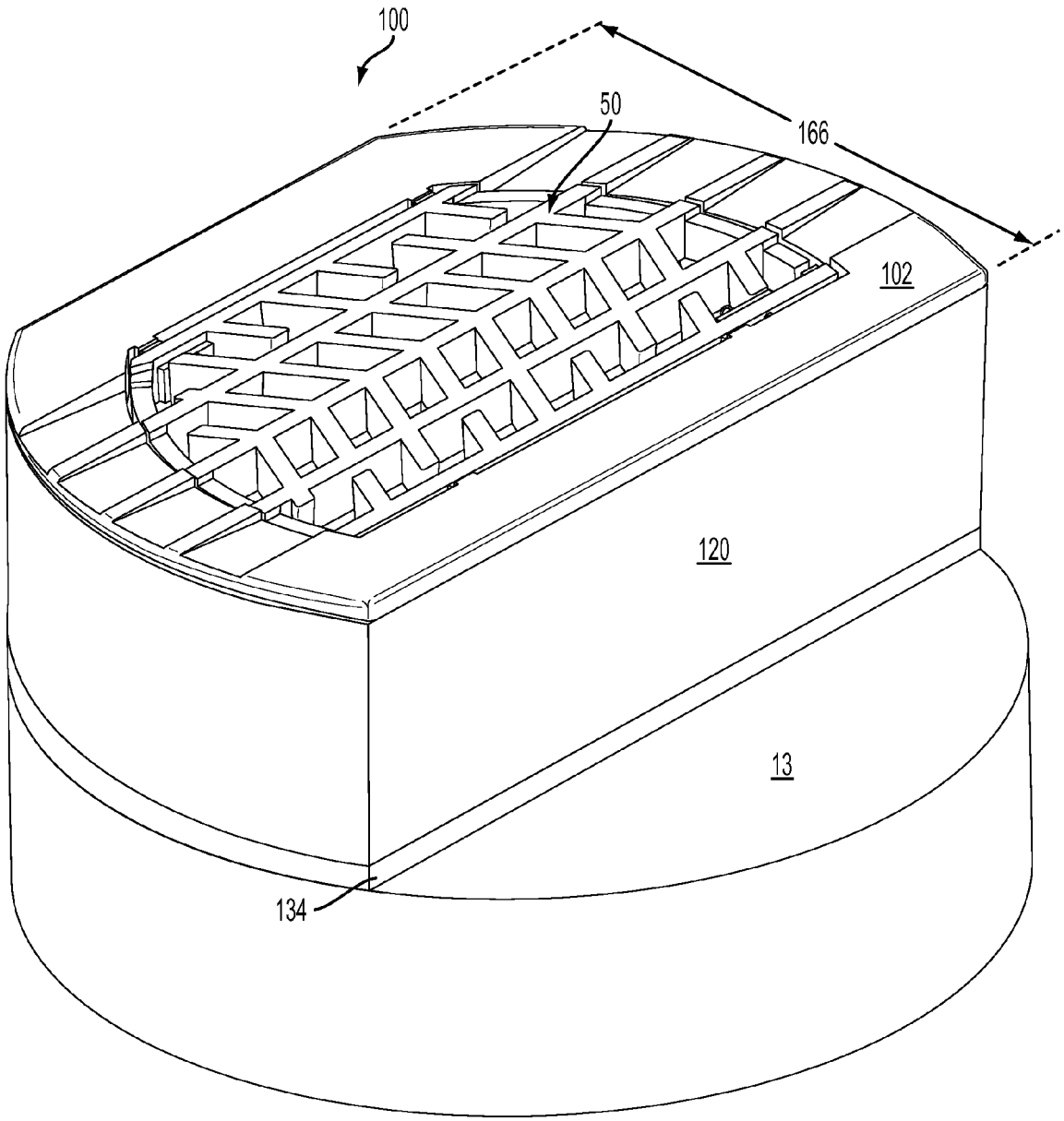
FIG. 6 is a perspective view of the frame of FIG. 4 disposed on the concrete head with a shim.
Figure 8:
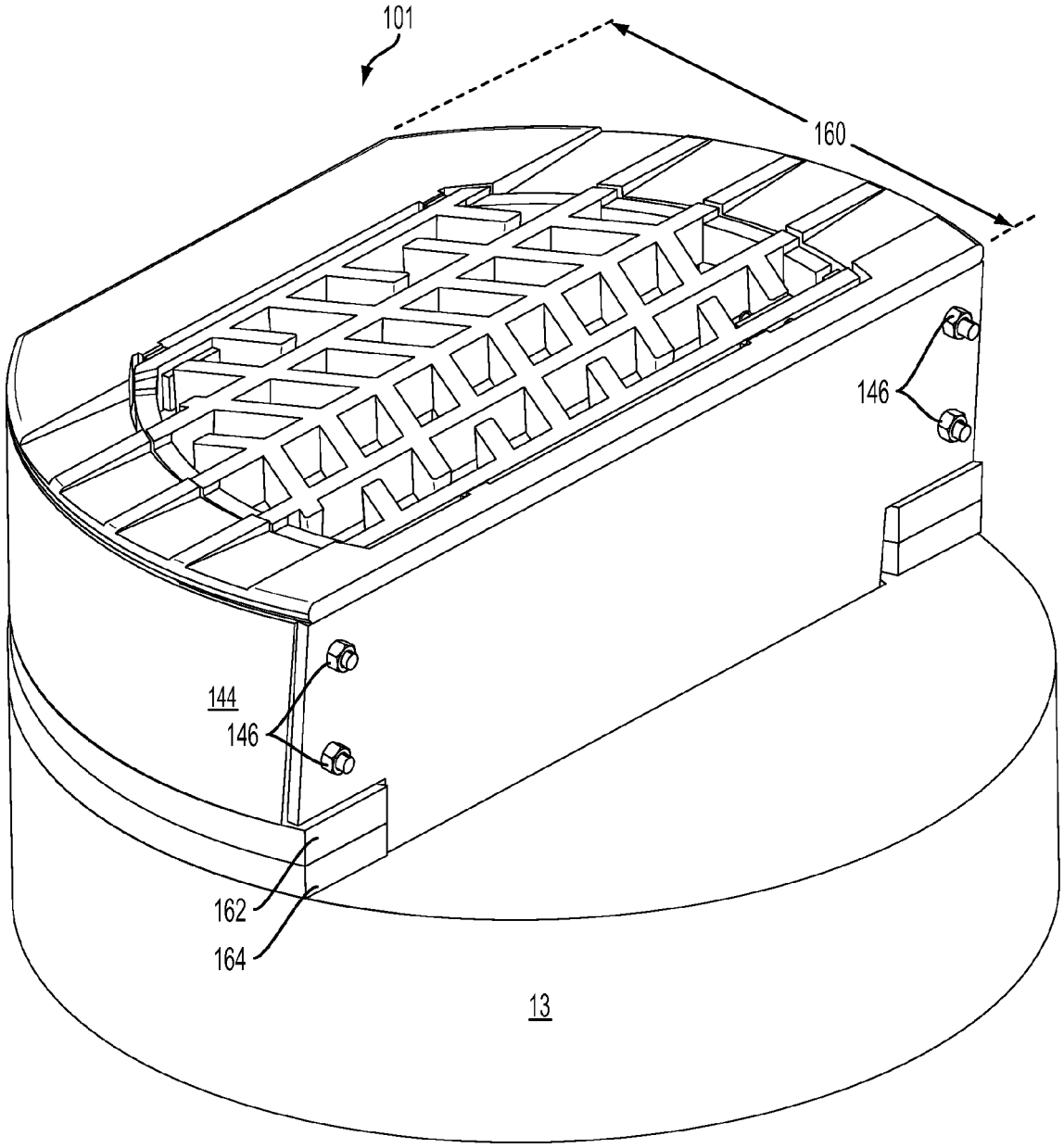
FIG. 8 is a perspective view of the alternative frame skeleton of FIG. 7 with a concrete sleeve on a concrete head with partly surrounding shims.

FIG. 6 shows the frame 100 inserted in the concrete sleeve 120 and further provided on concrete head 13 with a shim 134. Grate 50 is shown installed on frame 100. In FIG. 8, shims 162 and 164 only partly surround the frame skeleton 142 to further reduce the overall width of the grate, frame, concrete sleeve and shim combination from the original width 166 to a reduced width 160.

Although the concrete sleeve 120 is shown having a smooth external surface 121, it is contemplated that the concrete sleeve 120 could have lift pockets to facilitates its manipulation during transport for example.

As will be readily understood, the embodiment of FIG. 7 includes many alternatives to the embodiment of FIG. 3. Indeed, the flange 148 has a different shape with three radially extending sides instead of four for flange 100, wall 176 has extensions 176*a* and 176*b* and the anchor points 113 are replaced by openings 140 on extensions 176*a* and 176*b*. As will be readily understood, a further embodiment which includes only one or two of these alternative features is possible without departing from the present invention. For example, an embodiment with a flange of the type of FIG. 3 and the openings 140 could be used. Another embodiment with a flange of the type of FIG. 7 and the anchor points 113 could be used.

Figure 5:
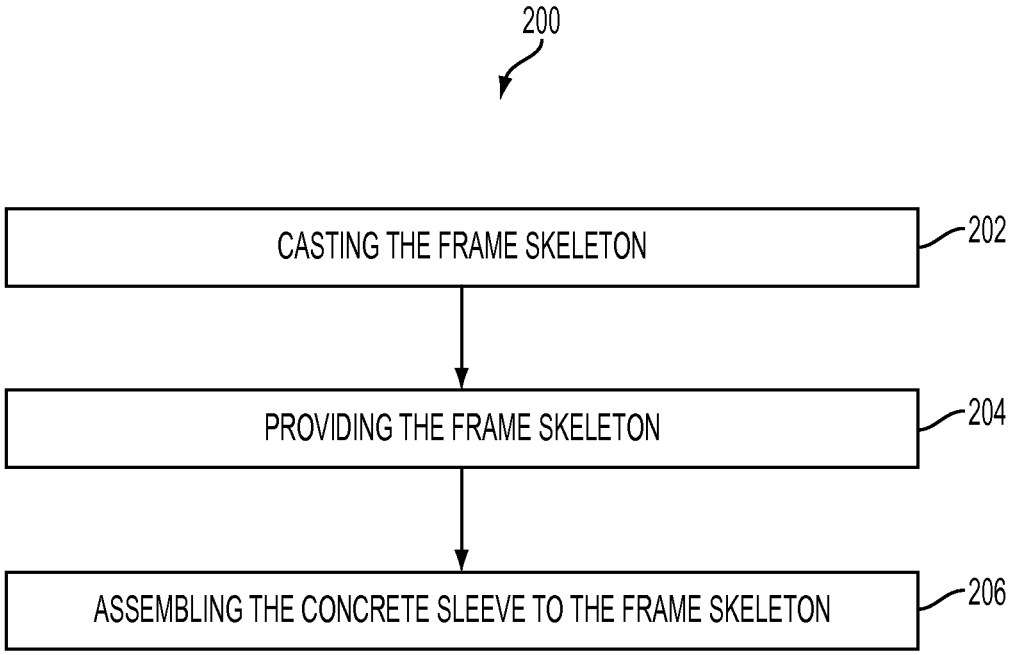
FIG. 5 is a block diagram of a method of making the frame of FIG. 2.

Turning now to FIG. 5, a method 200 for making the frame 100 will now be described. The method starts at step 202 with casting the frame skeleton 102. Melted iron is poured in a mold (not shown) having a negative print of the frame skeleton 102 so as to cast the frame skeleton 102. Once cooled, the mold is removed to reveal the frame skeleton 102 and at step 204, the frame skeleton 102 is provided for assembly with the concrete sleeve.

At step 206, the concrete sleeve 120 is assembled to the frame skeleton. The concrete sleeve 120 can be prepared independently or casted around the frame skeleton 102. If prepared independently, the concrete sleeve is then assembled to the frame skeleton by inserting the frame skeleton into the prepared concrete sleeve. The resulting frame can be secured by attaching the frame skeleton to the concrete sleeve or simply kept unitary by gravity. If the concrete sleeve 120 is casted around the frame skeleton 102, a mold for the concrete sleeve 120 is placed around the frame skeleton 102, and concrete is casted around the frame skeleton 102 inside the mold. Once cured, the mold is removed to reveal the assembled frame 100 which includes the frame skeleton 102 and the concrete sleeve 120. When using the alternative embodiment of FIGS. 7-8, an independently prepared concrete sleeve is typically used and attached to the frame skeleton 142 using attachment means such as screws and bolts 146 and openings 140. Other attachment means could be used rods, wires, bars, etc. Once assembled, the alternative frame 101 is ready to be used. Alternatively, the concrete sleeve could be casted around the frame skeleton using an appropriately shaped mold.

For some applications, the frame skeleton and the concrete sleeve manufacturers may be different entities. In that situation, the frame skeleton may be provided to the concrete sleeve manufacturer for the assembly with the concrete sleeve.

Once the frame 100 or 101 is made, it is being provided to the road construction site. The installation onto the catch basin inlet 17 is as follows (refer to FIGS. 2 and 6). In a first step, if it is not already done, the concrete head 13, which already made before assembly to the catch basin inlet 17, is disposed and assembled onto the catch basin inlet 17. The catch basin inlet 17 may be offset from the center of the catch basin or manhole to allow an installation of the frame and grate/cover as close as possible to the curb of the road. Gravel 7 is then backfilled around the catch basin inlet 17 and concrete head 13. One or more of shims 132, 134, 162 and 164 are disposed onto the concrete head 13 depending on the requirements of the installation. The shims are chosen to have a height 135 that will position the top surface of the frame 100 flush with the road 4. It is contemplated that a single shim could be used, that the shims could be omitted or that they could have a height 135 different from shown in the Figures or that they could have a varying thickness therefore allowing to install the frame at an angle to the inlet 17. The frame 100 or 101 is inserted into the inlet 17 of the catch basin 16. The gravel 7 is then backfilled around the shim 132, 134, and the road material 4 is poured on top of the gravel 7 around the frame 100 or 101. It is contemplated, however, that the road material 4 could be put around the frame 100 or 101 and the shims without using gravel. It is also contemplated that the steps of the above installation method could be performed in a different order, for example, the gravel 7 could be backfilled around the catch basin inlet 17 after the frame 100 or 101 is inserted into the inlet 17 of the catch basin 16, as long as the frame skeleton and the concrete sleeve are assembled to each other to form the frame 100 or 101 before assembling the frame to the catch basin 16. Unlike other methods, the frame skeleton and the concrete sleeve are first assembled together by inserting the frame skeleton in the concrete sleeve and relying on gravity, by casting the concrete sleeve around the frame skeleton or by attaching the concrete sleeve to the frame skeleton to form the assembled frame 100 or 101. Then, the assembled frame is provided for installation at the inlet of the manhole or catch basin, with or without the use of a concrete head.

Modifications and improvements to the above-described embodiments of the present may become apparent to those skilled in the art. The foregoing description is intended to be exemplary rather than limiting. The scope of the present is therefore intended to be limited solely by the scope of the appended claims.

The embodiments described above are intended to be exemplary only. The scope of the invention is therefore intended to be limited solely by the appended claims.

I claim:

1. A frame for a cover for one of a catch basin and a manhole, the one of the catch basin and the manhole having an inlet, the frame comprising:

a frame skeleton having a hollow body, the hollow body having a first end and a second end, the second end of the hollow body being adapted to be inserted into the inlet of the one of the catch basin and the manhole, the frame skeleton having at least one flange extending laterally outwardly from the first end of the hollow body, a surface of the at least one flange facing the second end being an under surface of the at least one flange; and a concrete sleeve disposed around the hollow body on an external surface thereof, the concrete sleeve being adapted to be disposed between the inlet of the one of the catch basin and manhole and the at least one flange, the concrete sleeve having a top surface abutting the under surface of the at least one flange, the under surface of at least one flange covering the top surface of the concrete sleeve, the hollow body of the frame skeleton being connected to the concrete sleeve, using at least one of at least one outwardly extending anchor point disposed on the external surface of the hollow body, the outwardly extending anchor point being adapted to connect with the concrete sleeve and;

at least one opening provided on an extension extending beyond the external surface of the hollow body, said opening being adapted to receive attachment means to connect with said concrete sleeve.

2. The frame of claim 1, wherein the hollow body has an asymmetrical cross-section.

3. The frame of claim 1, wherein the hollow body has a truncated circular cross-section.

4. The frame of claim 1, wherein the external surface of the hollow body is tapered outwardly from the second end to the first end of the hollow body.

5. The frame of claim 1, wherein the hollow body has an inside surface, and the inside surface is vertically straight.

6. The frame of claim 1, wherein the at least one flange includes at least one groove.

7. The frame of claim 1, wherein an outer perimeter of the at least one flange has a same shape of an inner perimeter of the at least one flange.

8. The frame of claim 1, wherein the at least one flange has at least one section with a width narrower than a main width of the at least one flange.

9. The frame of claim 1, wherein the frame skeleton includes a plurality of U-shaped anchor points disposed on an inside surface of the hollow body.

10. The frame of claim 1, wherein the hollow body has an inside surface, and the inside surface includes a recess at the first end of the hollow body for receiving the cover, the cover being one of a grate and a closed cover.

11. A method for making a frame for an inlet of one of a catch basin and a manhole, the method comprising:

providing a frame skeleton, the frame skeleton having a hollow body, the hollow body having a first end and a second end, the second end of the hollow body being adapted to be inserted into the inlet of the one of the catch basin and the manhole, the frame skeleton having at least one flange extending laterally outwardly from the first end of the hollow body, a surface of the at least one flange facing the second end being an under surface of the at least one flange; and assembling a concrete sleeve around the hollow body to form the frame before placing the frame into the inlet of the one of the catch basin and manhole, the concrete sleeve being adapted to be disposed between the inlet of one of the catch basin and manhole and the at least one flange, the concrete sleeve having a top surface abutting the under surface of the at least one flange, the under surface of at least one flange covering the top surface of the concrete sleeve, said assembling further comprising at least one of casting the concrete sleeve around the hollow body, on at least one outwardly extending anchor point disposed on the external surface of the hollow body; and attaching the concrete sleeve to the hollow body using attachment means and at least one opening provided on an extension extending beyond the external surface of the hollow body.

12. The method of claim 11, further comprising:

casting the frame skeleton before providing the frame skeleton.

* * * * *